US005447263A

United States Patent [19]

Tropper et al.

[11] Patent Number: 5,447,263

[45] Date of Patent: Sep. 5, 1995

[54] TAG ATTACHMENT APPARATUS

[75] Inventors: Solomon Tropper, Brooklyn, N.Y.; Kwok Y. Tang, New Territories, Hong Kong

[73] Assignee: Central Notion Co., Inc., Brooklyn, N.Y.

[21] Appl. No.: 250,936

[22] Filed: May 31, 1994

Related U.S. Application Data

[63] Continuation of Ser. No. 818,627, Jan. 10, 1992, abandoned.

[51] Int. Cl.[6] ..... B65C 7/00

[52] U.S. Cl. ..... 227/67; 227/136; 310/50

[58] Field of Search ..... 227/67, 68, 70, 71, 227/136; 173/170; 310/50; 493/376

[56] References Cited

U.S. PATENT DOCUMENTS

| | | | |
|---|---|---|---|
| 3,924,788 | 12/1975 | Furutu | 227/67 |
| 4,090,653 | 5/1978 | Furutu | 227/67 |
| 4,175,247 | 11/1979 | Klemm | 310/50 X |
| 4,187,970 | 2/1980 | Furutu | 227/67 X |
| 4,417,682 | 11/1983 | Furutsu | 227/67 |
| 4,423,837 | 1/1984 | Clements | 227/67 |
| 4,445,882 | 5/1984 | Ueno | 227/67 X |
| 4,456,162 | 6/1984 | Furutsu | 227/67 |
| 4,673,120 | 6/1987 | Strausburg | 227/67 |
| 4,751,452 | 6/1988 | Kilmer et al. | 310/50 X |
| 4,835,410 | 5/1989 | Bhagwat et al. | 310/50 X |
| 4,838,469 | 6/1989 | Strausburg | 227/67 |
| 4,923,106 | 5/1990 | Furutsu | 227/67 |
| 4,971,238 | 11/1990 | Furutsu | 227/67 X |
| 5,360,153 | 11/1994 | Cooper | 227/67 |

*Primary Examiner*—Rinaldi I. Rada
*Assistant Examiner*—Clark F. Dexter
*Attorney, Agent, or Firm*—Malina & Wolson

[57] ABSTRACT

A tag attachment apparatus includes a hollow needle mounted on a hollow pistol shaped housing. The housing includes a fastener feeding mechanism for feeding fasteners one at a time into the hollow needle. The fastners used with the apparatus each include a bar portion and a head portion which are connected by an elongated filament portion. A plunger mechanism is provided for driving the fasteners through the needle. The plunger mechanism is operated by an electric motor which is connected to a pair of rechargeable batteries mounted in the handle portion of the housing. A recharger circuit is also mounted in the handle of the housing for periodic recharging of the batteries.

16 Claims, 7 Drawing Sheets

TAG ATTACHMENT APPARATUS

This is a continuation of application Ser. No. 07/818,627 filed Jan. 10, 1992, now abandoned.

BACKGROUND OF THE INVENTION

The prior art related to the attachment of tags to garments or to articles made of fabric or similar sheet materials includes several examples of apparatus which are similar to the apparatus shown in U.S. Pat. No. 3,924,788. This apparatus is used with a flexible fastener which includes a bar portion, an elongated filament portion, or connecting portion, which projects sideways from the approximate center of the bar portion, and a head portion which is joined to an end of the filament portion. The fastener is preferably molded as a one-piece member using a plastic material such as nylon and has the general overall configuration of a capital letter H. In use, the bar portion is pierced through a garment or similar article and the filament portion holds a tag.

The apparatus shown in U.S. Pat. No. 3,924,788 includes a hollow needle and a hand operated lever mechanism which is operated to cause a driving rod to force the bar portion of a fastener into the bore of the needle. The driving rod forces the fastener through the bore of the needle and thereby through a portion of fabric which the needle penetrates. Withdrawal of the needle from the fabric allows the fastener to remain locked onto the fabric. The lever mechanism includes a spring which serves to return the lever mechanism to its original operating position. Use of this apparatus requires the operator to squeeze a portion of the mechanism in order to overcome the spring force.

The use of this apparatus under normal use conditions which typically involves the attachment of tags to a large number of garments, soon leads to a condition of hand strain and fatigue with consequent loss of efficiency. Prolonged use of such apparatus, which involves repetitive hand motion, can lead to medical conditions such as the recently noted carpal tunnel syndrome which can result in debilitating levels of discomfort and pain.

OBJECTS OF THE INVENTION

It is an object of the present invention to provide a tag attachment apparatus which can push the bar section of a flexible fastener through an elongated bore in a needle without resorting to a need for manually compressing portions of a lever mechanism.

Another object of the present invention is to provide a tag attachment apparatus which is operated by means of self contained batteries.

Another object of the present invention is to provide a tag attachment apparatus which incorporates rechargeable batteries and a battery recharger circuit.

Another object of the present invention is to provide a tag attachment apparatus in which a needle is provided having a sharpened portion which is adapted for cutting a shank portion which connects the bar portion of the fastener and a rod.

Another object of the present invention is to provide a tag attachment apparatus which is light in weight and which can be comfortably operated by hand for extended periods of time.

Another object of the present invention is to provide a motor operated tag attachment apparatus which has a self contained complement of batteries.

Still another object of the present invention is to provide a tag attachment apparatus which has a relatively small number of component parts which can be manufactured economically, thereby resulting in a relatively low unit cost.

SUMMARY OF THE INVENTION

In accordance with the present invention, there is provided a tag attachment apparatus which includes a needle, having a central bore, mounted on a hollow housing. The housing includes a fastener feeding mechanism for feeding the bar portion of the fasteners, one at a time, into the bore of the needle and a plunger mechanism for driving the fasteners through the needle. The plunger mechanism is operated by an electric motor which is connected to a pair of batteries which are mounted in a handle portion of the housing.

The housing has a pistol-like configuration and the electric motor is mounted in the rear portion of the housing which overlies the hand of an operator during normal use of the apparatus. This brings a significant portion of the weight of the apparatus over and to the rear of the hand and allows the apparatus to nestle into the hand of the operator without any hand strain.

In a preferred embodiment of the invention, the batteries are rechargeable batteries and a recharger circuit is mounted in the handle of the housing for periodic recharging of the batteries. The housing includes a release switch assembly which may be used to quickly clear any inadvertent jamming of fasteners in the feeding mechanism.

BRIEF DESCRIPTION OF THE DRAWINGS

Additional objects and a fuller understanding of the present invention may be had by referring to the drawings in which.

DETAILED DESCRIPTION OF THE INVENTION

Figure 1:
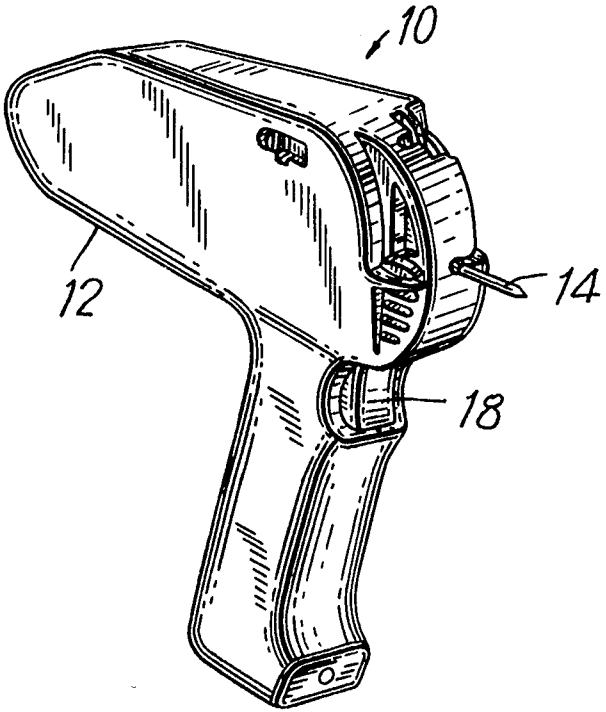
FIG. 1 is an overall perspective view of a tag attachment apparatus according to the present invention.
Figure 2:
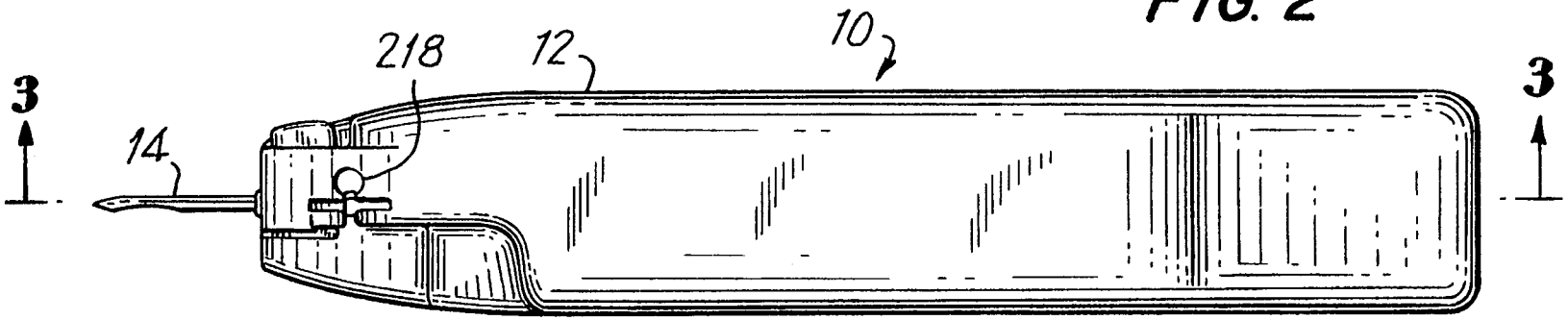
FIG. 2 is a top plan view of the tag attachment apparatus of FIG. 1.
Figure 3:
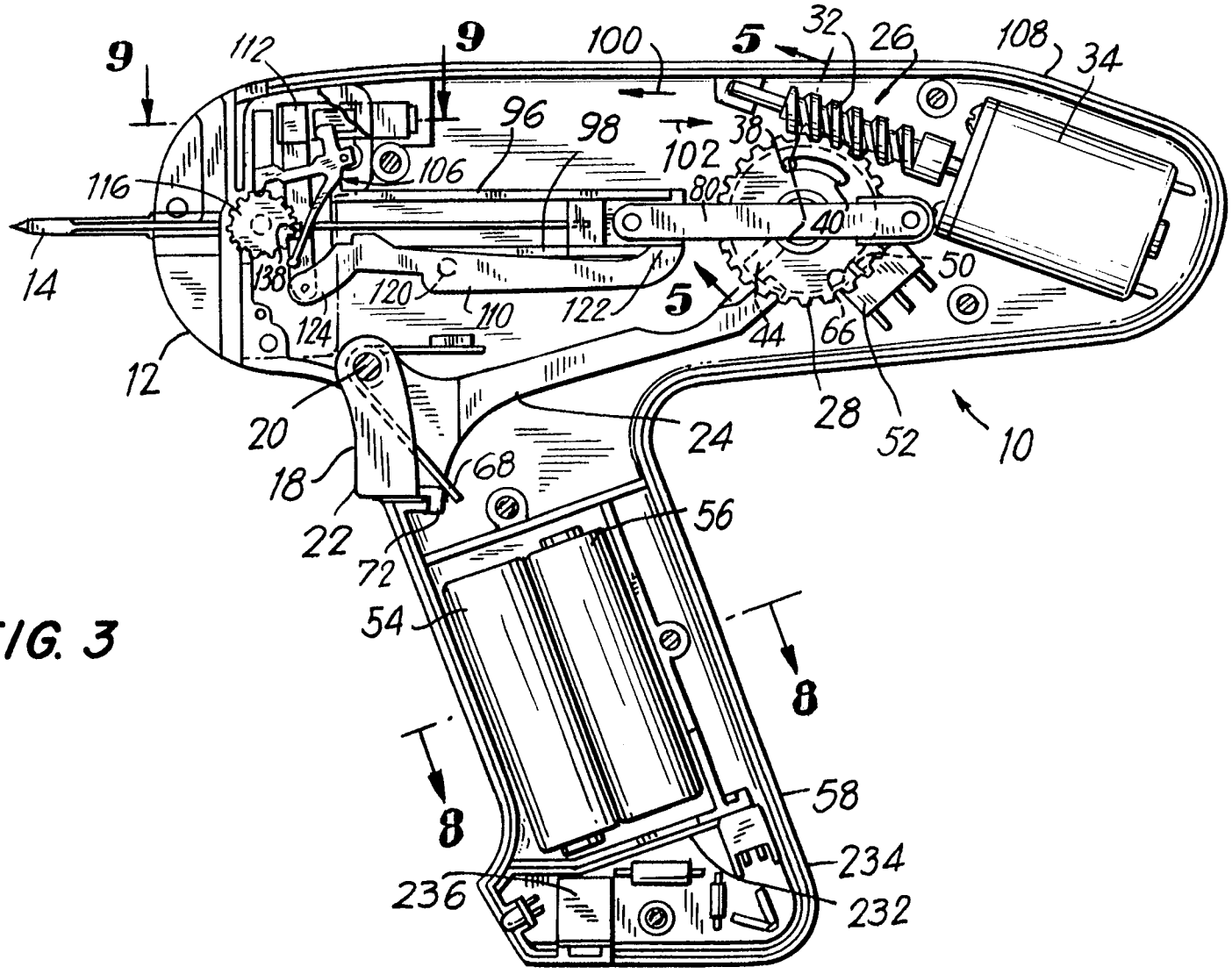
FIG. 3 is a cross-sectional view taken along the line 3—3 of FIG. 2.
Figure 6:
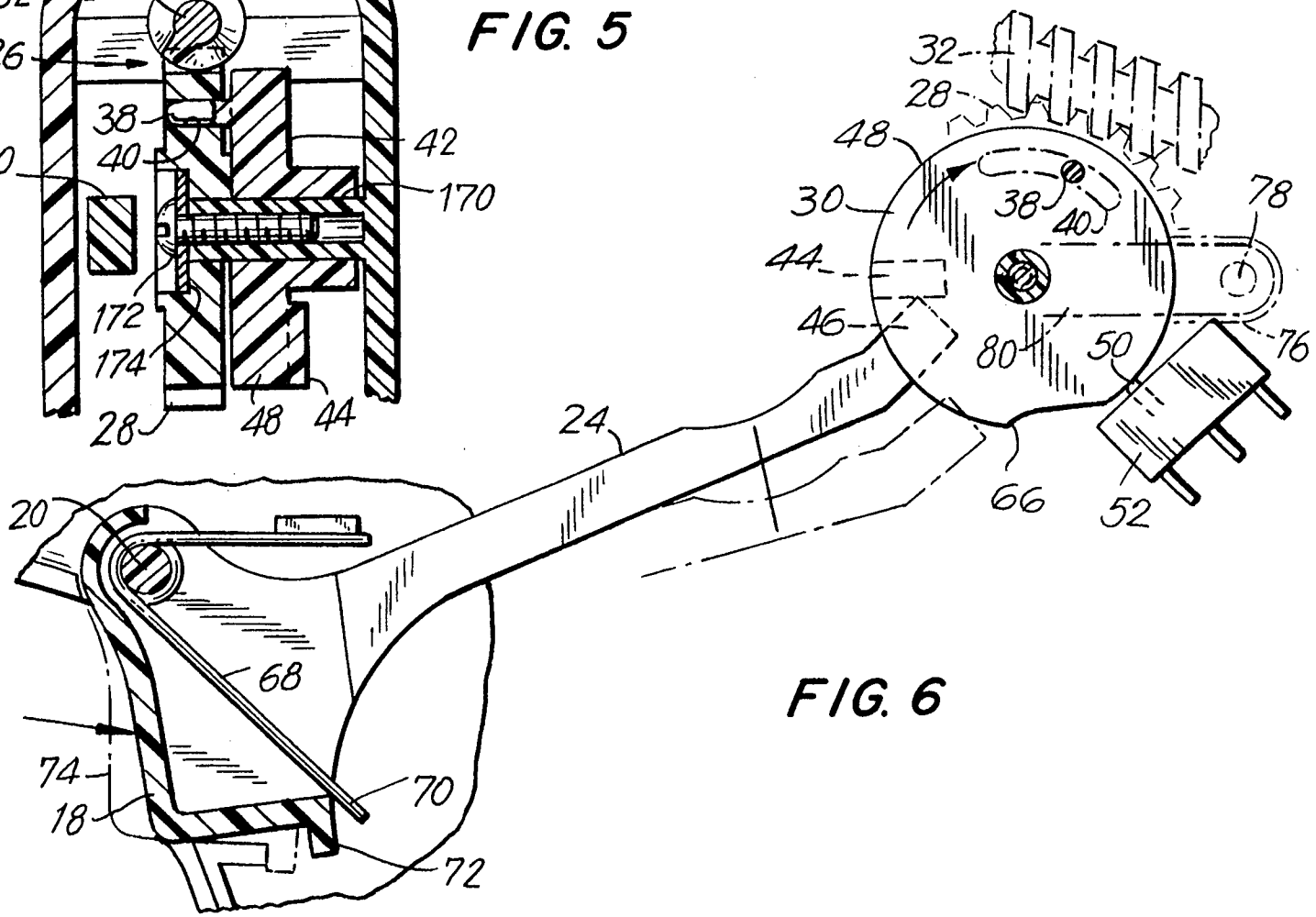
FIG. 6 is a fragmentary elevation view showing selected operating elements of the tag attachment apparatus drawn to an enlarged scale.
Figure 7:
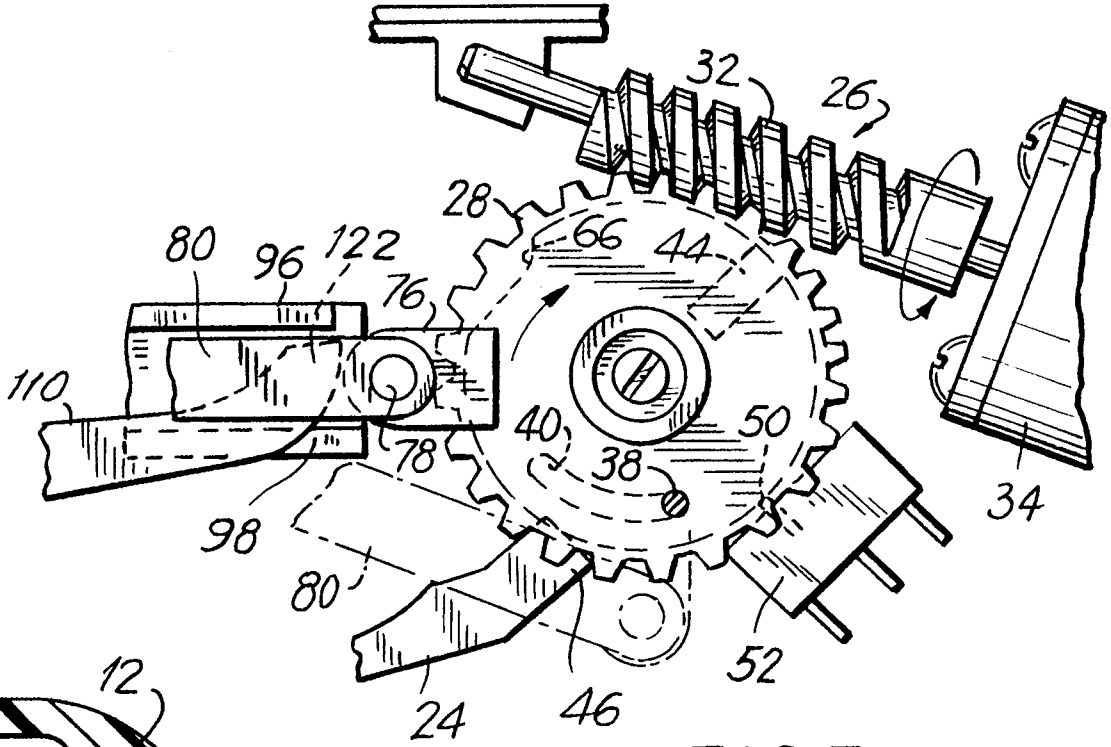
FIG. 7 is a fragmentary elevation view, generally similar to FIG. 6, showing the interaction of additional operating elements of the tag attachment apparatus.
Figure 8:
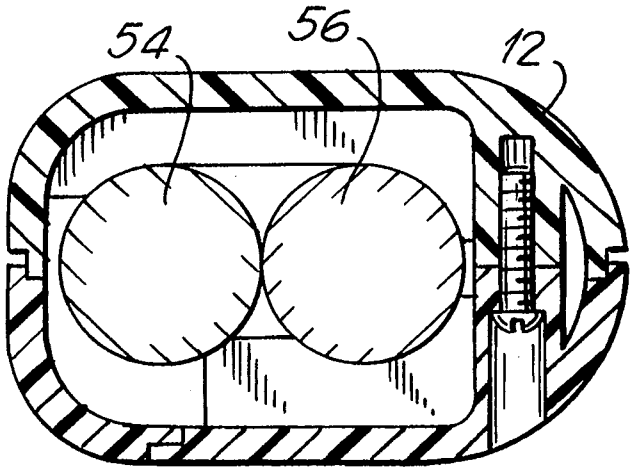
FIG. 8 is a cross-sectional view taken along the line 8—8 of FIG. 3.

With reference to the drawings there is shown in FIGS. 1 and 2 a tag attachment apparatus 10 which comprises a hollow housing 12 which has a generally pistol-like configuration and a hollow needle 14 which is used to attach fasteners 16 to portions of fabric or similar sheet materials. A trigger member 18 is mounted on the housing 12 by means of the pivot 20 as is shown in FIGS. 3 and 6. The trigger member 18 comprises a first portion 22 which projects outwardly with respect to the housing 12 and a second portion 24 which projects toward a gear assembly 26 which comprises one of the novel features of the present invention.

As is best shown in FIGS. 3, 4, 5 and 6, the gear assembly 26 includes a worm gear 28 and a coaxially mounted cam wheel 30. The worm gear 28 is in mesh with a worm 32 which is driven by a direct-current motor 34. The front surface 36 of the cam wheel 30 has a projecting pin 38 which rides in a curved slot 40 formed in the worm gear 28. The rear surface 42 of the cam wheel 30 includes a projecting plate 44 which is engaged by the end 46 of the second portion 24 of the trigger member 18 in a manner which will be presently described. The cam wheel 30 has a cam surface 48 which is in contact with, and depresses the actuating member 50 of a microswitch 52, as is best shown in FIG. 6. When the cam surface 48 is in contact with the microswitch 52 as shown in FIG. 6, the microswitch 52 is in the closed, i.e. ON position and electrical connections between the microswitch 52, the direct current motor 34, and a pair of batteries 54, 56 which are mounted in the handle portion 58 of the housing 12, cause the direct current motor 34 to rotate. The electrical connections described above are shown schematically in FIG. 13 and include leads 60, 62, 63, 64 which connect the microswitch 52, the motor 34, and the batteries 54, 56 in series with switch 52 in the OFF position. The electrical connections are conventional in nature and therefore need not be further described.

The cam wheel 30 has a depressed area 66 which is best shown in FIG. 6. When the depressed area 66 is proximate to the microswitch 52, the actuating member 50 of the microswitch 52 is released, thereby opening the circuit shown in FIG. 13 and the motor 34 immediately ceases to rotate.

Figure 13:
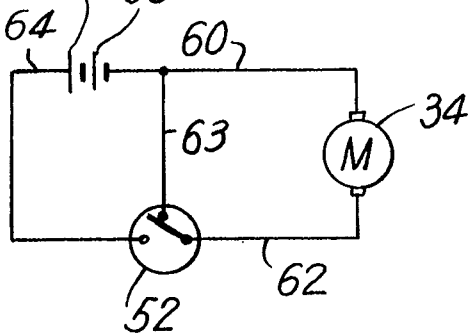
FIG. 13 is an electrical schematic diagram of the apparatus of FIG. 1.

As shown in FIG. 13, when the circuit is opened, i.e. switch 52 is in the OFF position, the lead 63 is connected across the motor 34, thereby providing a braking function.

Figure 4:
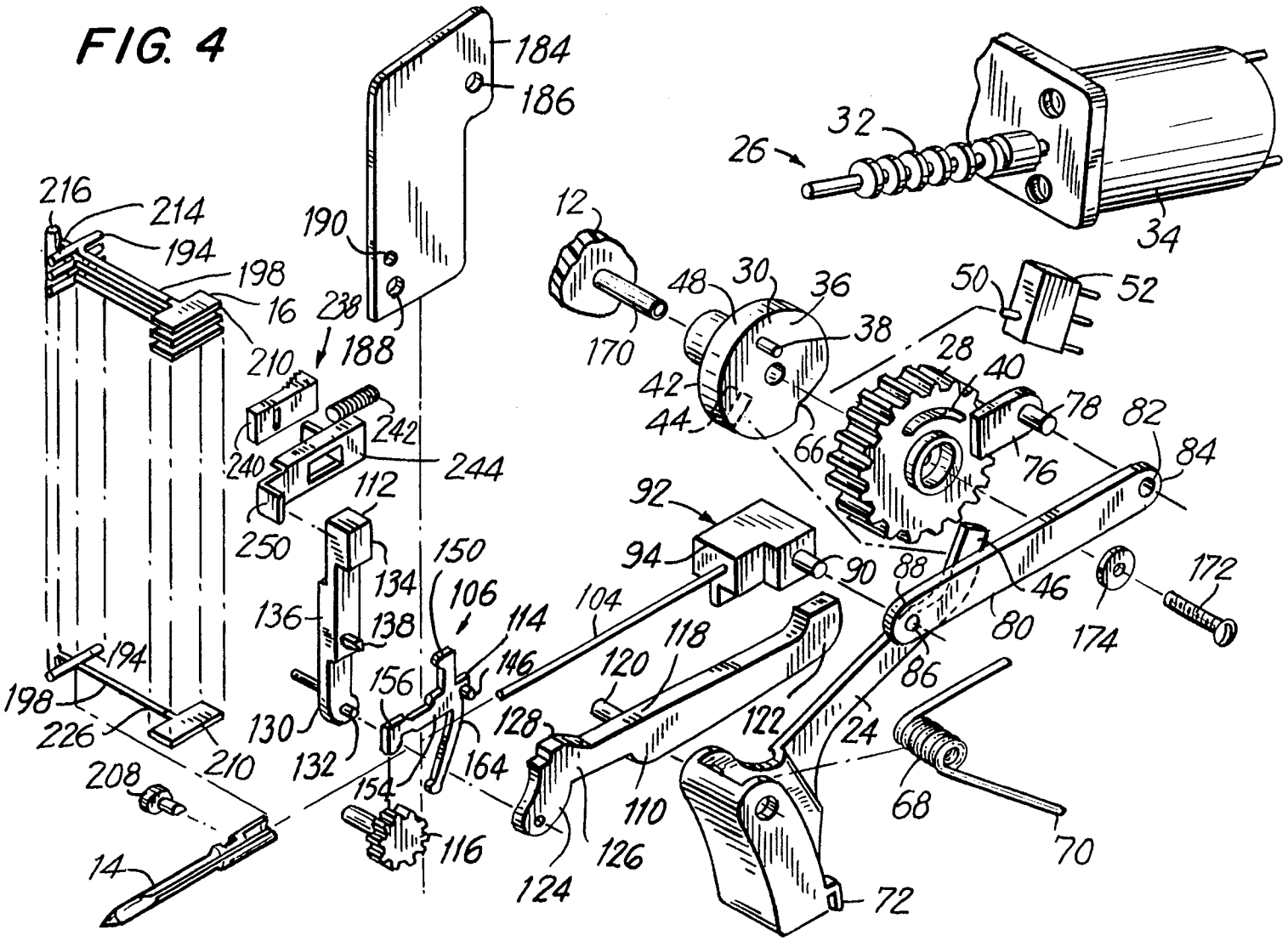
FIG. 4 is a fragmentary exploded view showing the operating elements of the tag attachment apparatus of FIG. 1.
Figure 5:
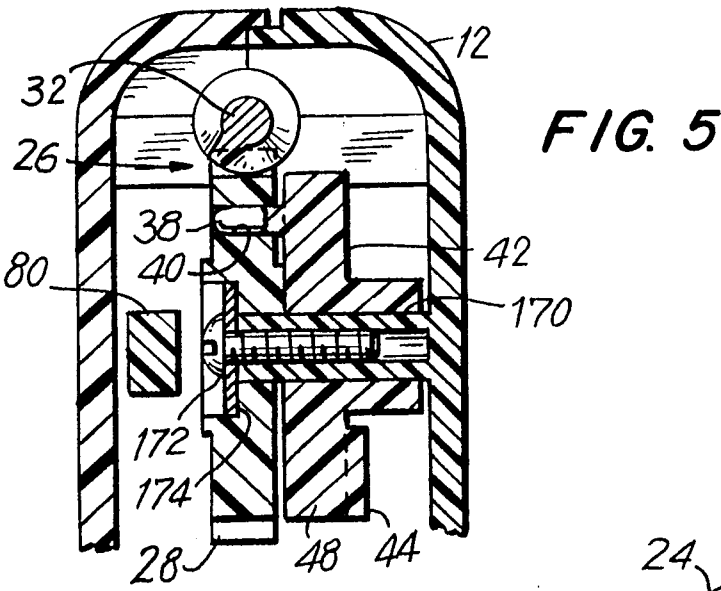
FIG. 5 is a fragmentary cross-section view taken along the line 5—5 of FIG. 3.

The worm gear 28 and the cam wheel 30 are mounted on the housing 12 by means of the integrally molded sleeve 170, the screw 172, and the washer 174, as is best shown in FIGS. 4 and 5.

A trigger spring 68 is mounted on the pivot 20 and has an end 70 which bears on a portion 72 of the trigger member 18 and biases the trigger member 18 toward the position shown in broken lines 74 in FIG. 6.

The worm gear 28 has an integrally molded pin block 76 from which a pin 78 projects. A crank member 80 is provided which has a hole 82 adjacent to a first end 84 and a hole 86 adjacent to a second end 88. The pin 78 engages the hole 82 thereby enabling the worm gear 28 to drive the crank member 80. The hole 86 engages a pin 90 which projects from a sliding block assembly 92. The sliding block assembly 92 includes a sliding block 94 which is guided by a pair of guide walls 96, 98 which are integrally formed in the housing 12, thereby causing the sliding block assembly 92 to slide in the directions shown by the arrows 100, 102 in FIG. 3. The sliding block assembly 92 includes a plunger member 104 which cooperates with the feeding assembly 106 in the feeding and insertion of the fastener 16, as will be presently described.

The mounting of the motor 34 in the rear 108 of the housing 12 in the position shown in FIG. 3 has the ergonomic benefit of placing the weight of the motor directly over the hand of the user and toward the rear of the user's hand. This allows the tag attachment apparatus 10, according to the present invention to nestle into the user's hand without hand strain on the part of the user and facilitates use of the apparatus 10 for extended periods without undue discomfort.

The feeding assembly 106 includes a sliding lever 110, a feeding rod 112, a feeding lock 114, and a feeding gear 116. The sliding lever 110 has a first intermediate portion 118 which is pivotally mounted on the housing 12 by means of the pin 120, a first end 122, and a second end 124. A second intermediate portion 126 includes a cam surface 128 which is disposed for actuation by the sliding block assembly 92. The second end 124 of the sliding lever 110 is pivotally connected to the lower end 130 of the feeding rod 112 by means of a pin 132.

Figure 10:
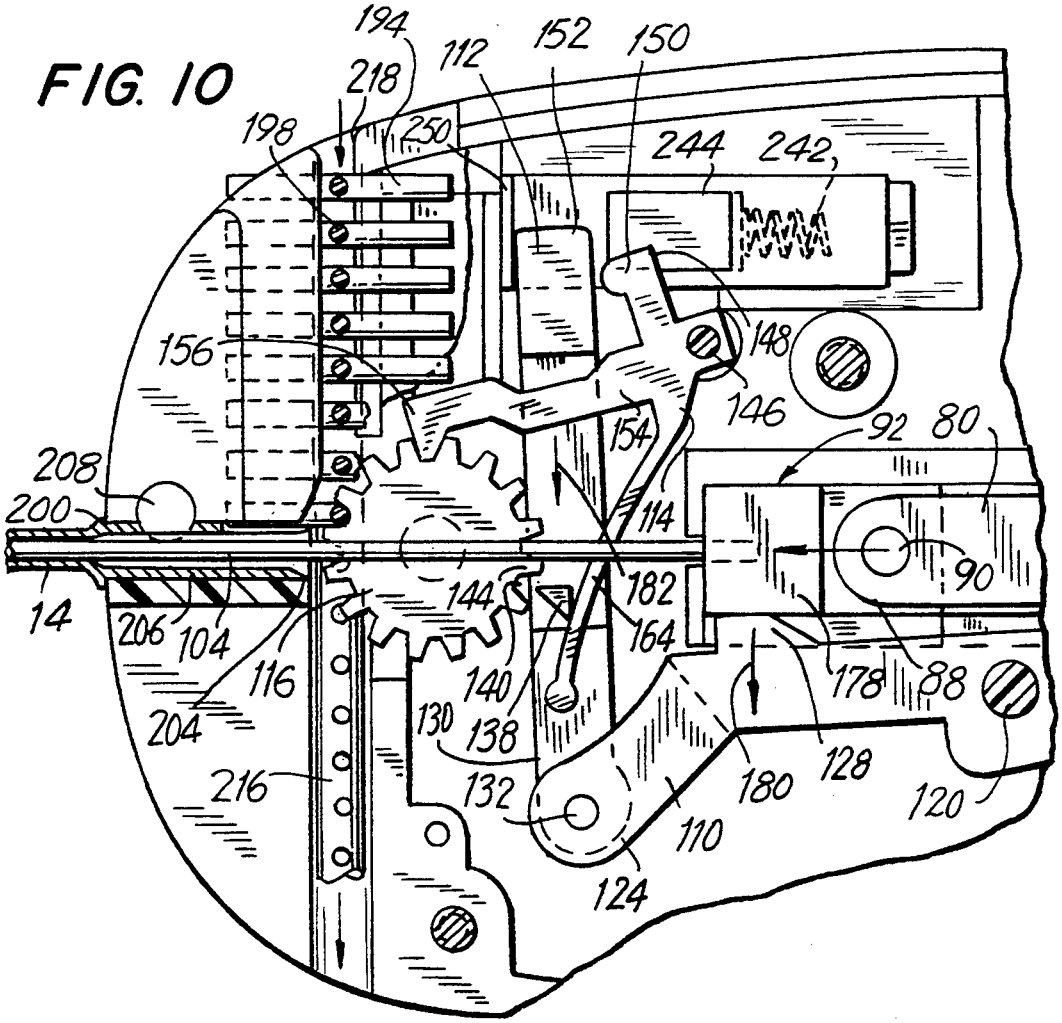
FIG. 10 is a fragmentary cross-sectional view similar to FIG. 3 drawn to an enlarged scale.

The feeding rod 112 has an upper end 134 which bears against the feeding lock 114 and an intermediate portion 136 which has a projecting portion 138 generally similar to a pawl which is capable of entering the space 140 between adjacent teeth 142, 144 of the feeding gear 116, as is shown in FIG. 10. The feeding lock 114 is pivotally connected to the housing 12 by means of the pin 146, the plate 184, and hole 190, and has three arm members. The first arm member 148 projects generally upwards with respect to the pin 146, when viewed as shown in FIG. 10, and has an end portion 150 which is capable of bearing on the upper end 134 of the feeding rod 112. The second arm member 154 of the feeding lock 114 projects to the left of the pin 146, when viewed as shown in FIG. 10, and has an end portion 156 which is capable of entering the space 158 between adjacent teeth 160, 162 of the feeding gear 116 in the manner of a pawl. The third arm member 164 of the feeding lock 114 projects downward, generally toward the sliding lever 110, and is generally slender, thereby resulting in a springlike quality. The third arm member 164 bears on the projecting portion 138 on the feeding rod 112 and urges the projecting portion 138 toward contact with the feeding gear 116.

Figure 11:
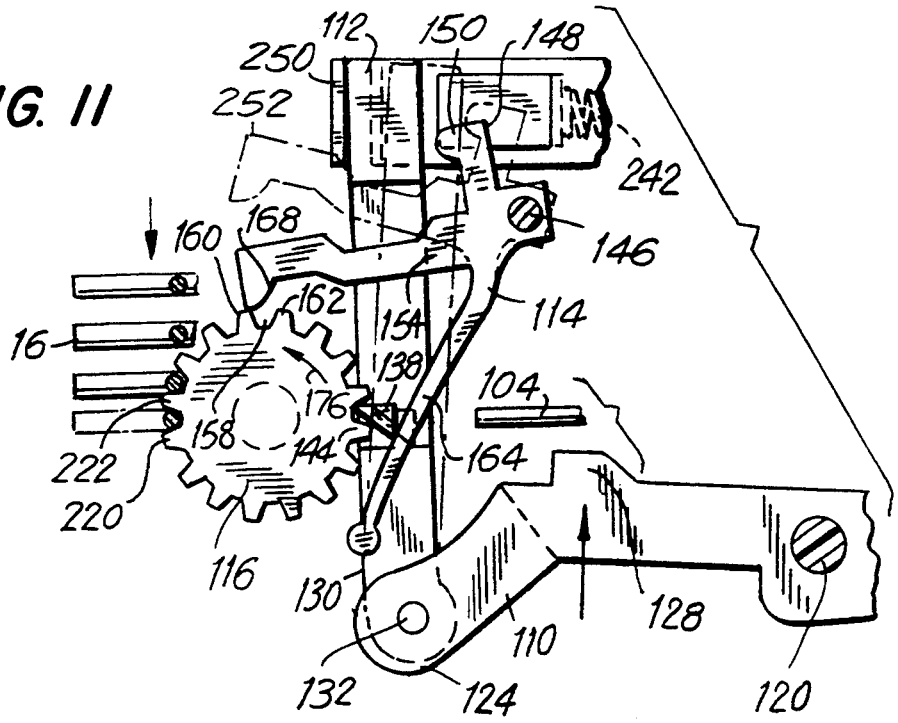
FIG. 11 is a fragmentary cross-sectional view similar to FIG. 11 showing the operation of the fastener feeding elements of the tag attachment apparatus of the present invention.

As is best shown in FIGS. 10 and 11, the end portion 156 has a straight surface 166 and a curved surface 168 and is capable of preventing rotation of the feeding gear 116 in the clock-wise direction, as viewed in FIG. 10, while permitting rotation of the feeding gear 116 in the counter-clockwise rotation as indicated by the arrow 176 in FIG. 11.

When the sliding block assembly 92 is extended toward the left when viewed as shown in FIG. 10, the sliding block 94 contacts the cam surface 128 on the sliding lever 110 causing the sliding lever 110 to rotate in the direction shown by the arrow 180 in FIG. 10. This motion of the sliding lever 110 causes the feeding rod 112 to move in the direction shown by the arrow 182 and causes the feeding lock 114 to lock the feeding gear 116 as a result of the engagement of the end portion 156 and the feeding gear 116.

When the sliding block assembly moves to the right, pressure of the sliding block assembly 92 on the end 122 of the sliding lever 110 causes the end 124 of the sliding lever 110 to move in an upward direction and thereby causing the feeding rod 112 to move in an upward direction as is shown in FIG. 11. This upward motion of the feeding rod 112 causes the projecting portion 138 of the feeding rod 112 to bear on the feeding gear 116 in a direction causing the feeding gear 116 to rotate in a counter-clockwise direction, thereby bringing a new fastener 216 into a position where it is in alignment with the needle 14 and is therefore ready for insertion.

As is indicated in FIG. 4, the plate 184 is attached to the housing by means of pins (which are not shown) which engage the holes 186, 188, whereby the various component parts are retained in their positions.

The needle 14 includes: a bore 192, which accepts the bar portion 194 of the fastener 16, and a slit 196, which accepts the filament portion 198, a flange portion 200, which abuts the housing 12, and an end portion 202. The end portion 202 has a sharpened end 204 and a notch 206. The needle 14 is removeably attached to the housing 12 by means of a lever member 208 and may be easily removed and replaced when necessary.

The fasteners used with the tag attachment apparatus 10, as previously described, include a bar portion 194, an elongated filament portion 198 which projects from the approximate center of the bar portion 194, and a head portion 210 which is joined to an end 212 of the filament portion 198. In the initial state, a plurality of fasteners 16 are joined together by means of a shank portion 214, formed on each of the fasteners 16, and which is directed opposite to said filaments 198, and a rod portion 216 which joins the shank portions 214, as is best shown in FIGS. 4 and 12.

During use, a plurality of fasteners 16 are inserted into a slot 218 formed in the housing 12 as shown in FIGS. 3 and 10 and the shank portions 214 engage the teeth 220, 222 of the feeding gear 116. When the trigger member 18 is depressed, the cam wheel 30 is rotated, thereby depressing the microswitch 52 and causing the motor 34 to drive the worm gear 28 and causing the sliding block assembly 92 to slide to the left as shown in FIG. 10. The end 224 of the plunger member 104 comes into contact with the bar portion 194 of the fastener 16 and continued travel of the sliding block assembly 92 brings the shank 214 to bear against the sharpened end portion 204 of the needle 14 with the bar 194 being pushed through the needle 14, as shown by the final position of the needle 16 being shown in broken lines 226 in FIG. 12.

Figure 12:
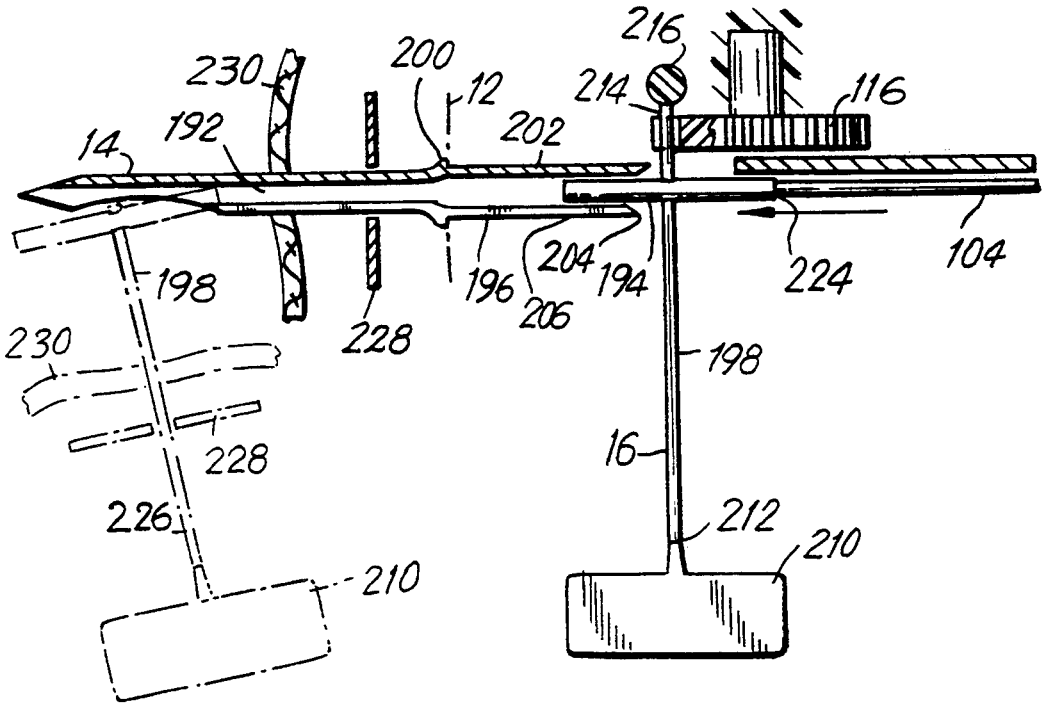
FIG. 12 is a fragmentary cross-sectional view showing the operation of the tag attachment apparatus in use during the attachment of a tag to a garment.

As shown in FIG. 12, the needle 14 has been passed through a tag 228 and has pierced a portion of a garment 230. In the final position the bar portion 194 of the fastener 16 has passed through the bore 192 of the needle 14 and retains the fastener 16 on the garment 230 while the tag is held by the filament portion 198.

In the preferred embodiment of the invention, which is shown in FIG. 3, the batteries 54, 56 are rechargeable batteries and a recharger circuit 232 is mounted in the lower portion 234 of the handle portion 58 of the housing 12. A connector 236 is mounted on the handle portion 58 in order to facilitate connection of the recharger circuit 232 to an external source of power.

Figure 9:
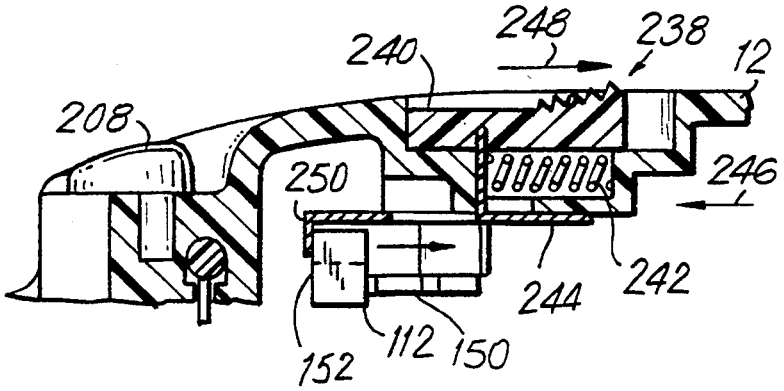
FIG. 9 is a fragmentary cross-sectional view taken along the line 9—9 of FIG. 3.

A release switch assembly 238, which is best shown in FIG. 9, is mounted on the housing 12 and may be used to clear any inadvertent jamming of the fasteners 16. The release switch assembly 238 includes a switch knob 240, a helical compression spring 242, and a switch bracket 244. The switch bracket 244 is slideably mounted on the housing 12 and the helical compression spring 242 urges the switch bracket 244 in the direction shown by the arrow 246 in FIG. 9. When the switch knob 240 is moved to the right as shown by the arrow 248 in FIG. 9, the switch bracket 244 also moves to the right and the portion 250 of the switch bracket 244 causes the upper end 134 of the feeding rod 112 to move to the right, thereby causing the feeding rod 112 to bear on the first arm member 148 of the feeding lock 114, causing the feeding lock 114 to rotate in a clockwise direction and disengaging the second arm 154 from the feeding gear 116, thereby unlocking the feeding gear and allowing jammed fasteners to be easily removed. The relative positions of the various components in the release switch assembly 238 are shown in broken lines 252 in FIG. 11.

An important feature of the present invention is the placement and arrangement of the internal component parts of the tagging apparatus 10 as best shown in FIG. 3. Thus, placement of D.C. motor 34 in the rear of the housing prevents the weight of the motor from causing fatigue during use. The placement of the operating elements in the upper portion of the housing has the additional advantage of having the handle portion of the housing conveniently available for the batteries 54, 56, thereby avoiding having the battery weight cause imbalance in the hand of the operator.

The location of the operating elements of apparatus 10 in the upper portion in a generally in-line configuration as shown in FIG. 3, provides advantages in operating reliability and maintainability. The overall number of component parts has been minimized resulting in increased reliability while convenient access to these parts has been provided, thereby resulting in an easily maintainable apparatus.

While a preferred embodiment of the invention has been shown and described herein, it is obvious that numerous additions, changes and omissions may be made in such embodiment without departing from the spirit and scope of the invention.

What is claimed is:

1. A tag attachment apparatus for use with plastic fasteners, each fastener including a bar portion and a head portion which are joined by an elongated filament portion, said apparatus comprising:

a hollow housing;

battery means mounted in said housing;

electric motor means mounted in said housing;

electrical connection means connecting said battery means with said electric motor means for delivering electricity from the battery means to the electric motor means;

needle means projecting from said housing for inserting one of said fasteners into a workpiece, said needle means having a central bore;

plunger means for driving said bar portion of said fastener through said central bore of said needle means;

fastener feeding means for feeding said fasteners into said bore of said needle means;

control means for control of said plunger means, with said control means and said fastener feeding means cooperating to insert said fasteners, one at a time, into said bore of said needle means and then drive said fastener through said bore, said control means comprising cam means rotatably mounted in said housing;

trigger means for engaging and rotating said cam means, said trigger means mounted on said housing with said trigger means having a portion directed toward said cam means;

electric switch means operated by said cam means, with said electric switch means connected to said electrical connection means for operation of said electric motor means responsive to actuation of said electrical switch means by rotation of said cam means caused by actuation of said trigger means;

a worm gear coaxially mounted on said cam means; and a worm member in mesh with said worm gear, said worm member connected with said electric motor means;

driving connection means connecting said plunger means with said worm gear;

said hollow housing comprising a first portion and a handle portion, said first portion including a first end, a second end and an intermediate section between said first and second ends, said handle portion projecting from said intermediate section, with said needle means mounted in said first end and with said electric motor means mounted in said second end.

2. A tag attachment apparatus according to claim 1 in which said cam means comprises a cam wheel having a circumferential surface formed with a depressed portion, said surface cooperating with said electric switch means to actuate said electric motor means and cause a single rotation of said worm gear when said trigger is pressed.

3. A tag attachment apparatus according to claim 1 in which a plurality of said fasteners are connected together to form an array, said apparatus further comprising fastener retaining means for retaining a plurality of said fasteners, said fastener retaining means formed in said housing and comprising a slot portion leading to said central bore of said needle means for feeding of said fastener to said central bore by said fastener feeding means.

4. A tag attachment apparatus according to claim 3 in which said fastener feeding means comprises feeding gear means mounted in said housing and located proximate to said needle means with said feeding gear means including gear teeth extending into said slot portion for engaging and moving said fasteners, one at a time, into said bore of said needle means.

5. A tag attachment apparatus according to claim 4 in which said fastener feeding means further comprises a feeding rod adjacent said feeding gear means with said feeding rod having a projection aligned with said gear teeth for rotating said feeding gear means, and sliding lever means for moving said feeding rod in response to a movement of said plunger means.

6. A tag attachment means according to claim 4 in which said needle means further comprises a sharpened portion disposed proximate to said feeding gear.

7. A tag attachment apparatus according to claim 4 in which said fastener feeding means further comprises sliding lever means, with said sliding lever means pivotally mounted on said housing, with said sliding lever means having end portions and an intermediate portion, connecting link means connecting an end portion of said sliding lever means to said feeding rod means, cam portions disposed on one of said end portions and on said intermediate portion of said sliding lever means and disposed on opposite sides of the pivotal mounting with said cam portions disposed for actuation by said plunger means to thereby coordinate said motion of said plunger means and said fastener feeding means.

8. A tag attachment apparatus according to claim 1 in which said battery means comprises rechargeable battery means.

9. A tag attachment apparatus according to claim 8 further comprising:

battery recharger circuit means mounted in said housing for recharging said rechargeable battery means, and electrical connector means for connecting said battery recharger circuit means to an external source of power.

10. A tag attachment apparatus according to claim 1 further comprising attachment means for removably attaching said needle means to said housing.

11. A tag attachment apparatus according to claim 1 in which said fastener feeding means comprises a feeding gear with said feeding gear rotatably mounted on said housing and with said feeding gear having a plurality of gear teeth capable of engaging said fasteners.

12. A tag apparatus according to claim 11 in which said fastener feeding means further comprises pawl means mounted in said housing with said pawl means engaging said feeding gear to ensure one-way rotation of said feeding gear.

13. A tag attachment apparatus according to claim 1 further comprising release switch means mounted on said housing with said release switch means connected to said fastener feeding means for enabling free movement of said fasteners in said fastener feeding means.

14. A tag attachment apparatus according to claim 13 in which said release switch means further comprises a release switch lever, spring means bearing on said release switch lever, connection means connecting said release switch lever and said fastener feeding means thereby enabling free movement of said fasteners in said fastener feeding means.

15. A tag attachment apparatus according to claim 1 in which the battery means is a rechargeable battery.

16. A tag attachment apparatus for use with plastic fasteners, each fastener including a bar portion and a head portion which are joined by an elongated filament portion, said apparatus comprising a hollow housing, electric motor means mounted within said housing, needle means projecting from said housing, with said needle means having a central bore, feeding gear means for feeding said fasteners to said needle means, said feeding gear means mounted in said housing and located proximate to said needle means with said feeding gear means including a gear piece for engaging and moving said fasteners, one at a time, into said bore of said needle means, plunger means for driving said bar portion of said fastener through said central bore of said needle means, a trigger means mounted on said housing for initiating a tag attachment operation by said apparatus, switch actuating means within said housing for actuating an electric switch means, said switch actuating means including a cam means rotatably mounted in said housing, said trigger means engaging and rotating said cam means, said electric switch means operated by said cam means, with said electric switch means being for operation of said electric motor means responsive to actuation of said trigger means and rotation of said cam means, a worm gear coaxially mounted on said cam means and connected to said plunger means, and a worm member in mesh with said worm gear, said worm member connected to said electric motor means for transferring power from the electric motor means to the worm gear to drive the plunger means.

* * * * *